United States Patent [19]

Rhinefrank et al.

[11] 4,218,984

[45] Aug. 26, 1980

[54] DRUM SEAMING MACHINE WITH COLUMN POSITIONING AND STROKE LIMITING ARRANGEMENT

[75] Inventors: Robert A. Rhinefrank; Vladimir E. Leibovich, both of Stockton, Calif.

[73] Assignee: Carando Machine Works, Stockton, Calif.

[21] Appl. No.: 26,363

[22] Filed: Apr. 2, 1979

[51] Int. Cl.³ ..... B21D 39/02

[52] U.S. Cl. ..... 113/1 E; 113/1 G; 113/23 R; 113/24 E; 113/120 Y

[58] Field of Search ..... 113/1 E, 1 F, 1 G, 120 Y, 113/24 R, 24 A, 24 E, 24 EA, 24 F, 24 EB, 24 D, 23 R

[56] References Cited

U.S. PATENT DOCUMENTS

| | | | |
|---|---|---|---|
| 1,826,506 | 10/1931 | Cotes | 113/20 B |
| 1,842,447 | 1/1932 | Dister | 113/28 |
| 2,101,291 | 12/1937 | Price | 113/30 |
| 2,104,224 | 1/1938 | Fisher | 113/30 |
| 3,672,317 | 6/1972 | Halling | 113/1 E |
| 4,004,529 | 1/1977 | Grotnes | 113/1 E |

*Primary Examiner*—Francis S. Husar
*Assistant Examiner*—Gene P. Crosby
*Attorney, Agent, or Firm*—Roger B. Webster

[57] ABSTRACT

A double-ended, drum seaming machine—which includes spaced, bed-supported columns carrying drum-engaging rotary chucks and drum seaming units—embodying a structural arrangement, in association with included stripper rods, which provides for pre-adjustment of the relative positions of the columns on the bed (according to drum length), and for predetermination of the limited-travel, working stroke of the individual columns between a retracted clearance position and an advanced position with the corresponding rotary chuck in drum head engagement.

19 Claims, 7 Drawing Figures

15
32
20
21
17
6
20
22
16
29
31
25
23
30
5
7
3
1
35
36
40
34
2
14
42
41

DRUM SEAMING MACHINE WITH COLUMN POSITIONING AND STROKE LIMITING ARRANGEMENT

BACKGROUND OF THE INVENTION

1. Field of the Invention

In the prior art, double-ended, drum seaming machines are known in sundry embodiments and wherein spaced columns are adjustably mounted on a bed to properly space them to accommodate, between the columns and the working parts thereon, drums of different lengths, and the columns each being power reciprocated through a limited-travel, working stroke between a retracted clearance position and an advanced position for engagement of the drum by such working parts. In the prior machines, the structural arrangements included to permit adjustment of the columns on the bed, and to provide for such limited-travel, working stroke of the individual columns, were—in many cases—too complex and costly or the necessary adjustments were inconvenient and time consuming to perform. The present invention was conceived in a successful effort to overcome—in a machine of the type described—such deficiencies.

2. The Prior Art

U.S. Pat. No. 4,004,529 is exemplary of the prior art known to applicants.

SUMMARY OF THE INVENTION

The present invention provides, as an important object, a drum seaming machine which embodies a novel structural arrangement—in association with included stripper rods—for ready and convenient pre-adjustment of the relative positions of the power-reciprocated columns on the supporting bed (according to drum length), and for pre-determination of the limited-travel, working stroke of the individual columns between a retracted clearance position and an advanced working position with the included column-mounted chuck in drum head engagement preparatory to initiation of the seaming operations. The structural arrangement provided, to attain the above objectives, is relatively simple and yet functionally effective.

The present invention provides, as another important object, a drum seaming machine, as above, wherein the normally stationary stripper rods—corresponding to each column—pass, with a running fit, through the latter; and said structural arrangement includes spaced stop elements on the rods adapted to engage with the column and limit the working stroke thereof to a predetermined, relatively short distance.

The present invention provides, as still another object, a drum seaming machine, as above, wherein the stripper rods are adjustably secured in connection with the bed, whereby—upon longitudinal adjustment of the stripper rods, corresponding pre-adjustment of the column of the bed is effected in a ready and facile manner, and for the purpose of accommodating drums of different lengths.

The present invention provides, as a further object, a drum seaming machine with the described improvements which is designed for ease and economy of manufacture.

The present invention provides, as a still further object, a practical, reliable, and durable drum seaming machine with the described improvements, and one which is exceedingly effective for the purpose for which it is designed.

DESCRIPTION OF THE PREFERRED EMBODIMENT

Figure 1:
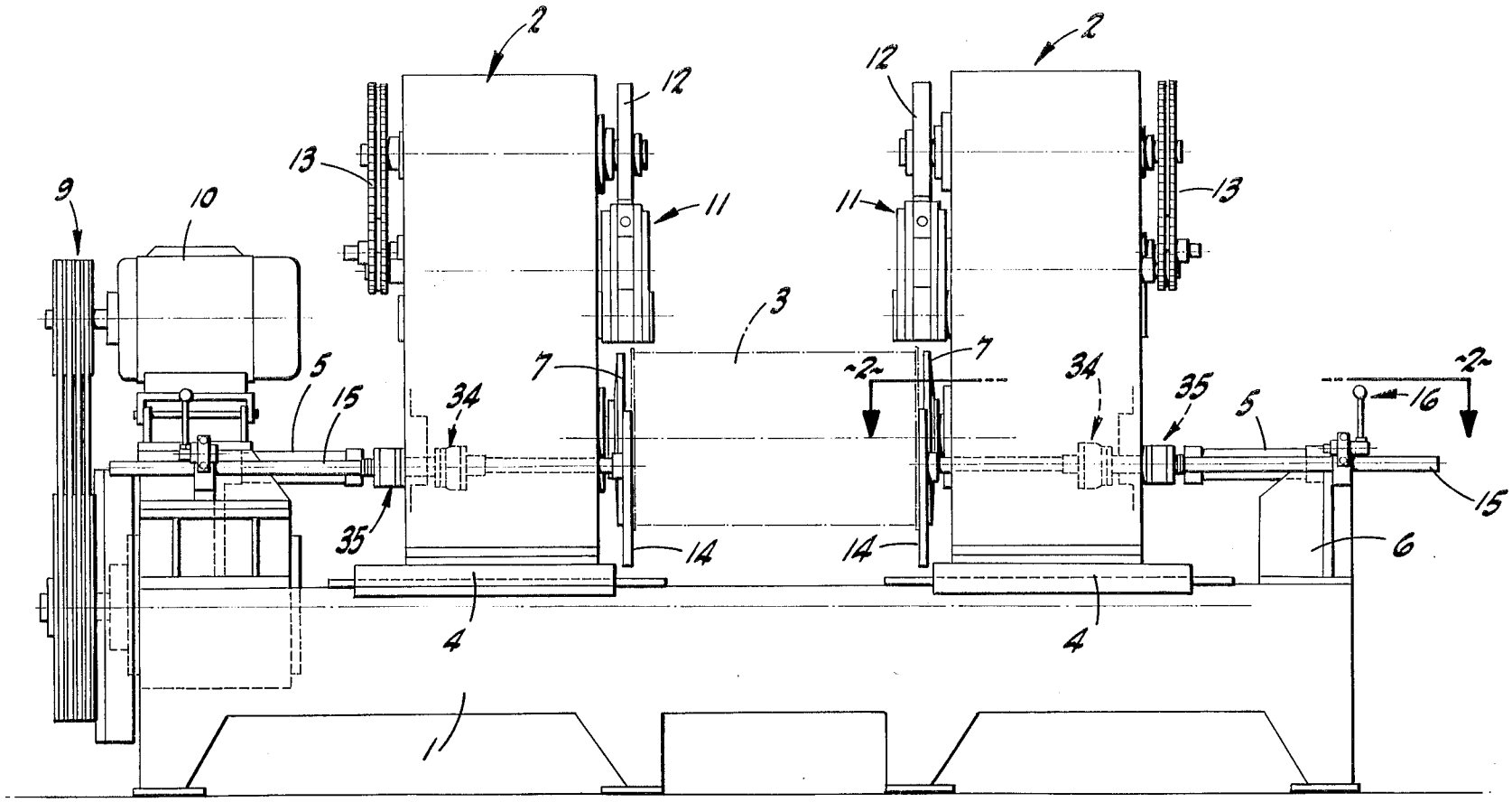
FIG. 1 is a side elevation, partly in outline and omitting the drum elevating cradle unit, of a double-ended, drum seaming machine embodying the present invention.
Figure 2:
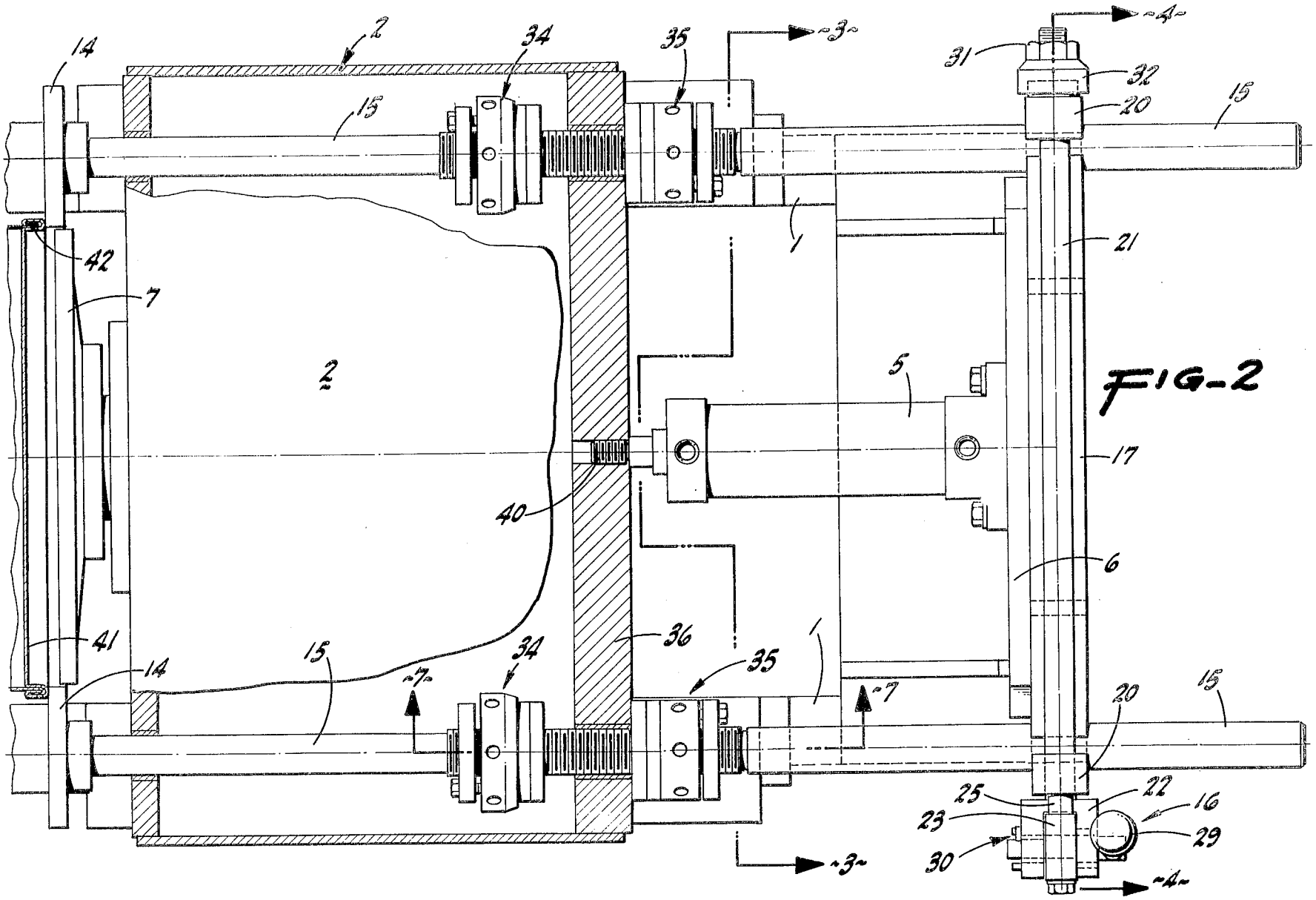
FIG. 2 is an enlarged, fragmentary, sectional plan view taken substantially on line 2—2 of FIG. 1.
Figure 3:
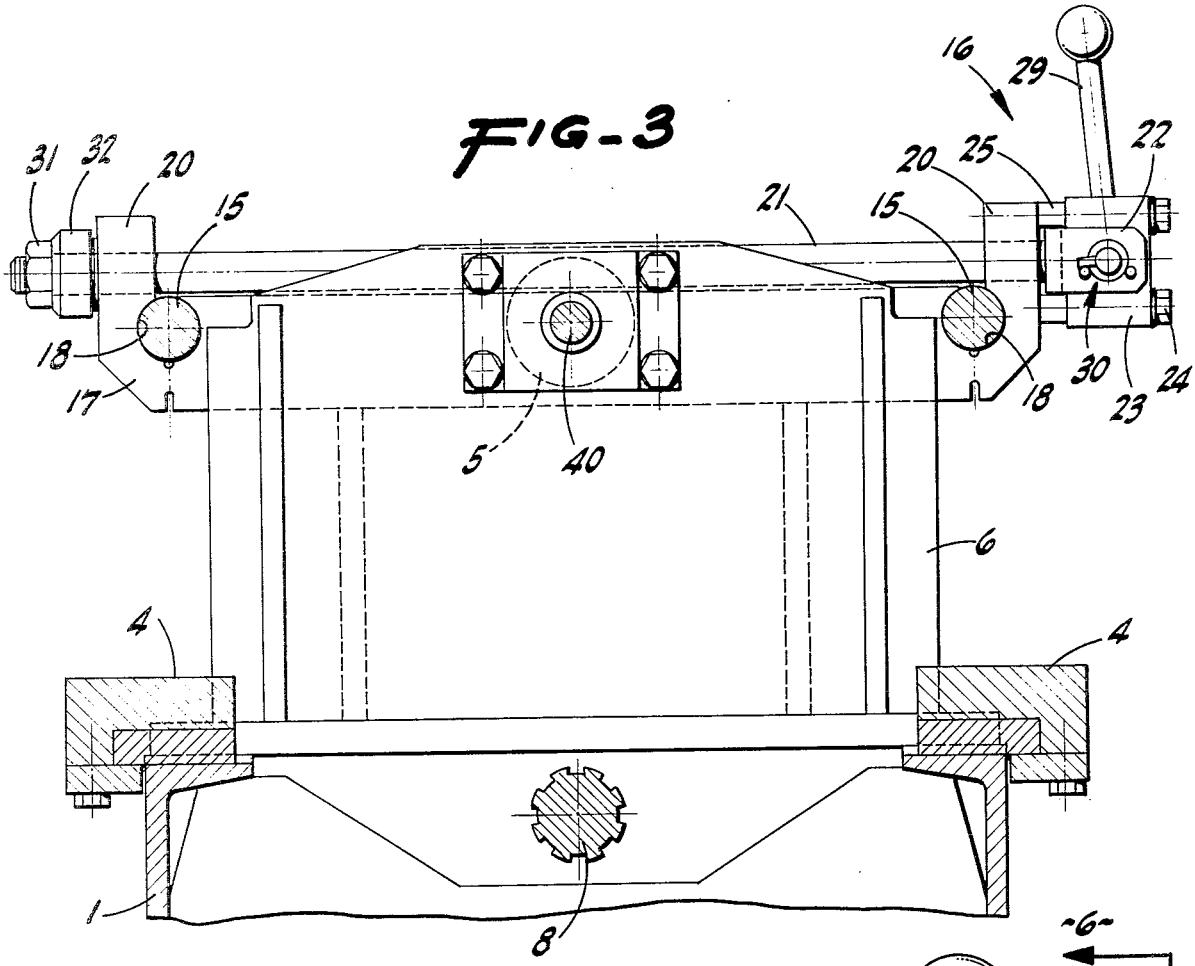
FIG. 3 is a transverse, vertical section taken substantially on line 3—3 of FIG. 2.
Figure 4:
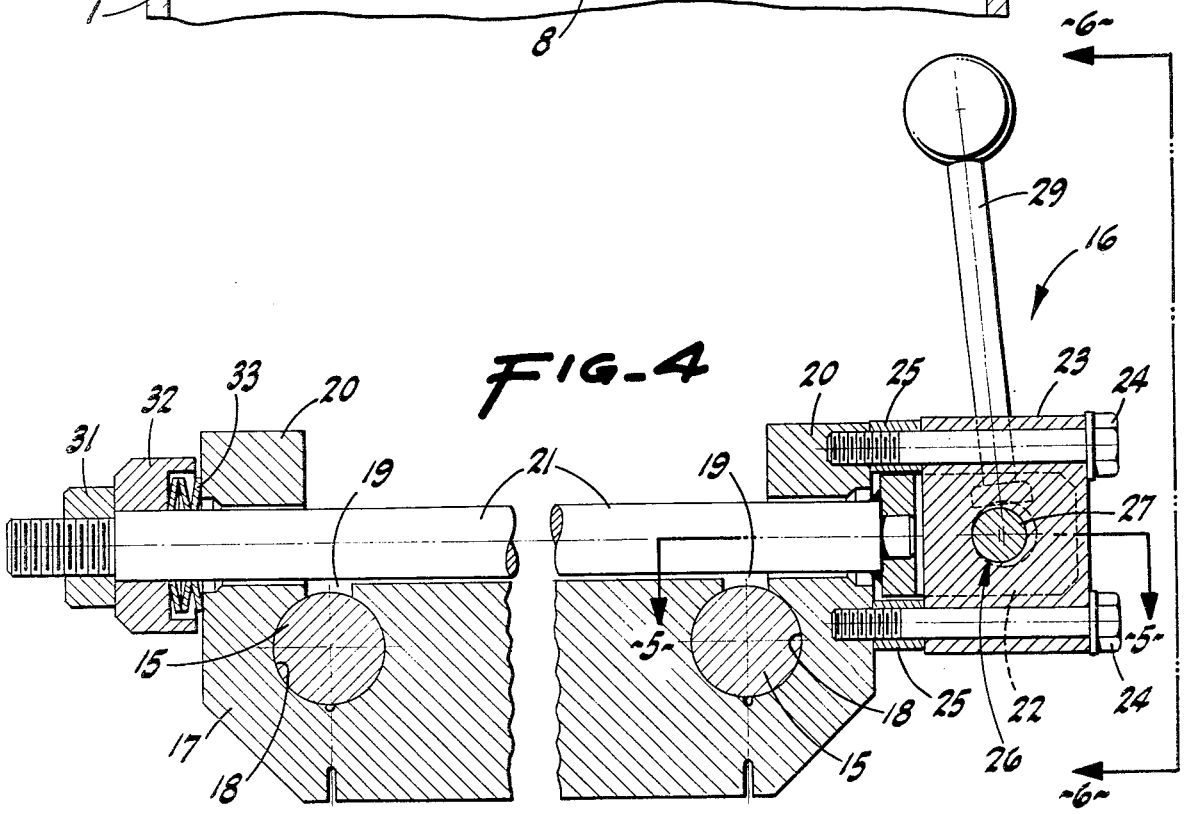
FIG. 4 is a transverse, vertical section taken substantially on line 4—4 of FIG. 2.
Figure 5:
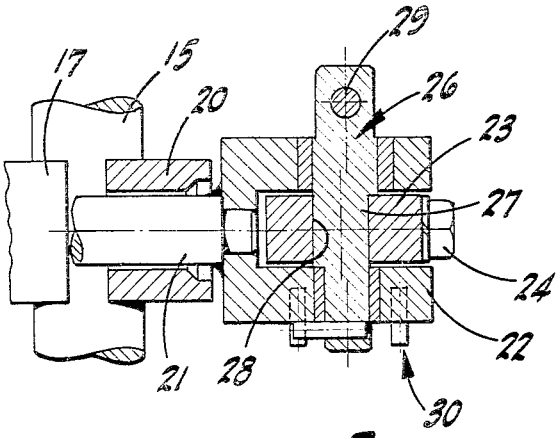
FIG. 5 is a fragmentary, sectional plan view taken substantially on line 5—5 of FIG. 4.
Figure 6:
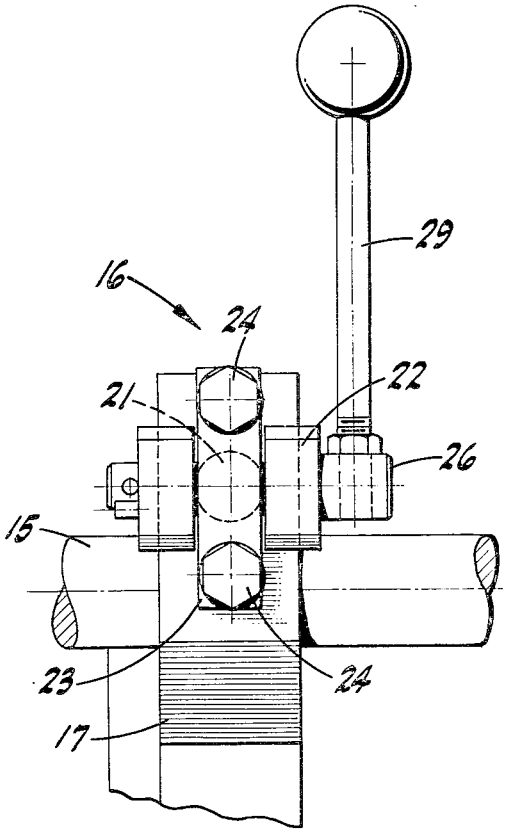
FIG. 6 is a vertical, end elevation taken substantially on line 6—6 of FIG. 4.
Figure 7:
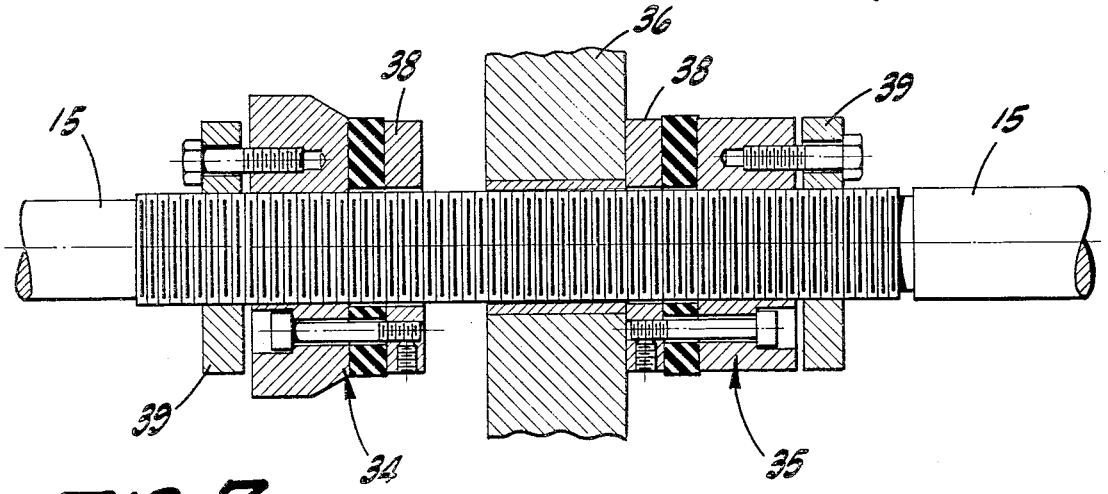
FIG. 7 is a fragmentary, vertical, sectional elevation taken substantially on line 7—7 of FIG. 2.

Referring now more particularly to the drawings and to the characters of reference marked thereon, the present invention is directed to a double-ended, drum seaming machine (shown in somewhat greater detail in co-pending application Ser. No. 21,027, filed Mar. 16, 1979) embodying a longitudinal bed 1 which supports heavy-duty columns 2 in spaced relation and for reception therebetween of a horizontal axis drum 3 supported in position, for drum head seaming, by a cradle unit (not shown). The columns 2 are mounted on the bed by slides 4 which permit the columns to be adjusted in spacing and to accommodate therebetween drums of different lengths. Such adjustment of each of the columns is effected by a horizontal, longitudinally extending, double-acting power cylinder 5 connected between a fixed tailstock 6 on the bed, and the corresponding column 2.

Adjacent the working faces thereof, the individual columns each carry a circular chuck 7 journaled on the column and driven, in suitable fashion, from a main shaft 8 in the bed 1 lengthwise thereof and powered by an endless drive 9 from an electric motor 10 mounted atop a related tailstock 6.

Above the driven chuck 7 of each column 2, the latter supports a drum seaming unit indicated generally at 11 and shown in greater detail in the aforesaid co-pending application; such drum seaming unit including a rotary cam 12 driven, in timed relation to the chuck 7, from the main shaft 8 and by means shown only in part at 13 and which is an endless timing chain.

Each chuck 7 is peripherally embraced, at least in the lower half thereof, by a drum stripper 14 disposed in a transverse, vertical plane; such stripper being substantially conventional. The stripper 14, corresponding to each column, is fixed on and supported by longitudinal, transversely spaced stripper rods 15 which extend from the stripper 14 in a rearward direction to normally fixed but releasable connection with the tailstock 6 by means of a clamping unit indicated generally at 16. Consequently, when—in working position, pre-set as later described—each column 2 is retracted by its power cylinder 5, the related stripper 14 relatively advances a short distance and then projects slightly ahead of the chuck 7 to strip the drum (after seaming) from such chuck. See FIG. 1. Conversely, when each column 2 is advanced by its power cylinder 5, the related stripper 14 projects slightly behind the chuck to permit the latter to enter the near head, of the drum, preparatory to initiation of the seaming operation on a drum head engaged on and spanning between the chucks 7.

The clamping unit 16 corresponding to each set or pair of stripper rods 15 (i.e., the set at each end of the machine) comprises the following:

A cross member 17 is included with the tailstock 6, and at each end such cross member is formed with an integral, split-type clamp 17 having a bore 18 through which the related stripper rod 15 extends; each clamp 17 being vertically and longitudinally split, as at 19, centrally above the corresponding bore 18, and, additionally, includes an integral ear 20 upstanding to the outside of the split. The ears are alined laterally of the machine, and a cross rod 21 spans between and passes through coaxial bores in said ears.

At one end thereof, the cross rod 21 is secured to a horizontal, upwardly opening yoke 22 which straddles a vertical block 23 fixedly secured to the adjacent ear 20 by bolts 24 and spacer collars 25. A transverse shaft 26 spans between and is journaled in the sides of yoke 22; such shaft—intermediate its ends and within the confines of the block—being formed with an eccentric section 27 received in a bore 28 in said block. At one end, and beyond the yoke 22, the transverse shaft 26 is fitted with a radial hand lever 29 movable from a horizontal, outwardly projecting position to an upright position. A pin and stop array, indicated generally at 30, is provided at the other exposed end of the transverse shaft 26 for the purpose of limiting the hand lever 29 against movement beyond the above positions.

At the other end (i.e., the end opposite the above-described yoke, block, and transverse shaft assembly), the cross rod 21 is provided with a threaded-on nut 31 which bears against an inwardly opening cap 32 which surrounds the cross rod 21 and embraces a plurality of heavy-duty spring washers 33, on said rod, disposed between such cap and the adjacent ear 20.

When the hand lever 29 is manually swung from its horizontal, outwardly projecting position to an upright position, the eccentric section 27 of transverse shaft 26 turns in bore 28 and the shaft ends act to cause slight but forceful motion of yoke 22 relative to the fixed block 23. Such relative motion is translated into an axially outward load or tension on the cross rod 21, and which tension—after compression of the spring washers 33—imposes a laterally inward force on both of the ears 20 and which force tends to narrow the splits 19, with the result that the clamps 17 grip both stripper rods 15 and hold the same against longitudinal movement. The stripper rods 15 are thus clampingly held in a fixed position during normal operation of the can seaming machine.

Both of the parallel stripper rods 15, at each end of the machine, extend through the corresponding column 2 loosely or with a running fit, and—within the column—each stripper rod is provided with a threaded-on front stop nut 34, while a rear stop nut 35 is threaded on each stripper rod 15 rearwardly of column 2. Thus, the rear wall 36 of said column—in a thickened portion thereof—is disposed between the front stop nut 34 and rear stop nut 35 on the individual stripper rods 15.

Each of the stop nuts 34–35 includes, at the end adjacent the rear wall 36, a shock-absorbing collar 37—of rubber or the like—faced by a retention ring 38, while at the opposite end each of said nuts 34–35 is provided with a locking ring 39 which holds the related nut in any adjusted position on its stripper rod 15.

When the drum seaming machine is in operation, operation of each power cylinder 5—to extend its piston rod 40—causes the connected column 2 to advance a distance limited by engagement of the rear wall 36 of said column with the front stop nuts 34; such advance of the column 2 thrusting the rotary chuck 7 into the head 41 of the alined drum 3, whence the related seaming unit 11 is brought into play to produce the seam 42. Thereafter, operation of the power cylinder to retract the piston rod 40 causes corresponding retro-motion of the column and which draws the rotary chuck 7 away from the drum, and at the same time the stationary stripper 14 frees the drum head from the chuck. Such retro-motion of the column is limited by engagement of the rear stop nuts 35 with the rear wall 36 of said column. From the above it will be understood that—with each cycle of operation of the drum seaming machine—the piston rod 40 is once reciprocated to impart corresponding advance and retraction of the corresponding column 2 through a working stroke of limited-travel, and which stroke is predetermined by the adjusted position of the front and rear stop nuts 34–35 on the normally stationary stripper rods 15. While the arrangement is quite simple structurally, it provides for an effective and accurate limited-travel stroke of each column, and yet a stroke can be readily adjusted to accommodate, for example, drum heads of varying depths.

Beyond their purpose to limit column travel, as above, the stop nuts 34–35 on the stripper rods 15 have another purpose. More particularly, prior to operation of the drum seaming machine, each column 2 is pre-adjusted longitudinally on the bed and as necessitated by the length of the drums to be handled in the machine; such pre-adjustment being accomplished readily, easily, and quickly, as follows:

Firstly, the clamping unit 16 corresponding to each column is quick-released by manual movement of the hand lever 29 to a "down" outwardly projecting position, and which releases both of the clamps 17. Secondly, the power cylinder is actuated to cause advance (or retration, as the case may be) of the column on the bed and to the position requisite for the next drum seaming operation. Lastly, after such pre-adjustment of the column has occurred, and at which time the stripper rods 15 have slidably moved in the clamps 17, said clamps are re-engaged (by moving hand lever 29 back to its upright position) whereby the clamping unit 16 "locks" the column in said pre-adjusted position.

From the foregoing description, it will be readily seen that there has been produced such a drum seaming machine with the described improvements as substantially fulfills the objects of the invention as set forth herein.

While this specification sets forth in detail the present and preferred construction of the drum seaming machine with the described improvements, still in practice such deviations from such detail may be resorted to as do not form a departure from the spirit of the invention as defined by the appended claims.

We claim:

1. A drum seaming machine including a bed, a column supported by and movable along the bed, a drum-engaging chuck journaled on the column adjacent one face thereof, a tailstock on the bed spaced from the opposite face of the column, power means connected between the tailstock and column to reciprocate the latter on the bed, a drum stripper associated with the chuck, at least one longitudinal stripper rod fixed at one end to the stripper and thence extending toward and normally fixed in connection with the tailstock, and column stop means on the stripper rod operative in contact with the column to limit reciprocal travel thereof between a pre-selected advanced position and a retracted position.

2. A machine, as in claim 1, in which the column stop means includes stop members in normally fixed, longitudinally spaced relation on the stripper rod, and said stop members being positioned to individually contact the column in stop relation upon the column reaching a corresponding one of said positions.

3. A machine, as in claim 2, in which the stripper rod extends through a wall of the column, and said stop members being disposed with said wall therebetween whereby wall contact by said stop members effects said limit of travel of the column.

4. A machine, as in claim 3, in which the stop members are stop nuts threaded on the stripper rod in normally fixed but adjustable relation.

5. A machine, as in claim 4, in which each stop nut includes a cushion collar which provides shock absorption when such stop nut contacts said wall of the column.

6. A machine, as in claim 1, including quick-release clamping means in the connection between the stripper rod and the tailstock; said quick-release clamping means permitting, when released, movement of the stripper rod and column relative to the bed a distance greater than said limit of travel whereby the column may be pre-positioned on the bed.

7. A machine, as in claim 6, in which said quick-release clamping means includes a clamp through which the stripper rod extends, the clamp including a turnable eccentric which normally maintains the clamp in rod-gripping engagement, and a hand lever connected to the eccentric and adapted for movement to a position in which the eccentric is turned and releases the clamp.

8. A drum seaming machine including a bed, a column supported by and movable along the bed, a drum-engaging chuck journaled on the column adjacent one face thereof, a tailstock on the bed spaced from the opposite face of the column, power means connected between the tailstock and column to reciprocate the latter on the bed, a drum stripper associated with the chuck, a pair of transversely spaced, parallel, longitudinal stripper rods fixed at one end to the stripper and thence extending toward the tailstock, means securing the stripper rods in connection with the tailstock in normally fixed relation, and column stop means on the stripper rods operative in contact with the column to limit reciprocal travel thereof between a pre-selected advanced position and a retracted position.

9. A machine, as in claim 8, in which the column stop means includes stop members in normally fixed, longitudinally spaced relation on each stripper rod, the corresponding stop members on said rods being laterally alined, and said stop members on each rod being positioned with a fixed part of the column therebetween.

10. A machine, as in claim 9, in which said fixed part of the column is a wall thereof; the stripper rods extending through the column, with said wall between the stop members on each rod.

11. A drum seaming machine including a bed, a column supported by and movable along the bed, a drum-engaging chuck journaled on the column adjacent one face thereof, a tailstock on the bed spaced from the opposite face of the column, power means connected between the tailstock and column to reciprocate the latter on the bed, a drum stripper associated with the chuck, a pair of transversely spaced, parallel, longitudinal stripper rods fixed at one end to the stripper and thence extending toward the tailstock, means securing the stripper rods in connection with the tailstock in normally fixed relation, the stripper rods passing through the column, and a pair of stop nuts threaded on each stripper rod in longitudinally spaced relation and with a wall of the column disposed therebetween, corresponding stop nuts of the pairs being laterally alined and operative in contact with said wall to limit reciprocal travel of the column between a pre-selected advanced position and a retracted position.

12. A machine, as in claim 11, in which each stop nut includes a cushion collar which provides shock absorption when such nut contacts said wall of the column.

13. A drum seaming machine including a bed, a column supported by and movable along the bed, a drum-engaging chuck journaled on the column adjacent one face thereof, a tailstock on the bed spaced from the opposite face of the column, power means connected between the tailstock and column to reciprocate the latter on the bed, a drum stripper associated with the chuck, a pair of transversely spaced, parallel, longitudinal stripper rods fixed at one end to the stripper and thence extending toward the tailstock, quick-releasable clamping means securing the stripper rods in connection with the tailstock in normally fixed relation, and stop means operative to limit reciprocal travel of the column between a pre-selected advanced position and a retracted position.

14. A machine, as in claim 13, in which the quick-releasable clamping means includes clamps corresponding to and normally clampingly engaging the stripper rods, and means to simultaneously release said clamps.

15. A machine, as in claim 14, in which said clamp-releasing means includes a hand lever adapted for movement to a position in which said clamps are released.

16. A machine, as in claim 13, in which the quick-releasable clamping means includes clamps engaging the stripper rods, the clamps being of split-type and each having a bore through which the corresponding stripper rod extends and a projecting ear disposed to the outside of the split, the ears being alined laterally of the machine and having coaxial bores, a cross rod spanning between the ears and extending through the bores therein, stop means on one end of the cross rod engaging the adjacent ear, and releasable means between the other end of the cross rod and the related ear operative to normally impose tension on the cross rod whereby to then urge the ears toward each other and cause the clamps to grip the stripper rods.

17. A machine, as in claim 16, in which said releasable means includes a turnable eccentric which normally maintains the cross rod under tension, and a hand lever connected to the eccentric and adapted for movement to a position in which the eccentric is turned and relieves the tension on the cross rod.

18. A machine, as in claim 16, in which said releasable means includes a yoke on said other end of the cross rod, a block fixed to said related ear and disposed in the yoke, a transverse shaft journaled in and spanning the yoke, said transverse shaft having an eccentric section extending in turnable relation in the block, the eccentric normally being in a position with the transverse shaft imposing, through the yoke, said tension on the cross rod, and a hand lever on the cross shaft adapted for movement to a position in which the eccentric is turned and said tension is relieved.

19. A machine, as in claim 16, in which said stop means includes a nut on the cross rod, and a heavy-duty spring washer on the rod between the nut and said adjacent ear.

* * * * *